US007318765B1

(12) United States Patent
Hartelius

(10) Patent No.: US 7,318,765 B1
(45) **Date of Patent: *Jan. 15, 2008**

(54) BALLOON INFLATING AND ILLUMINATING DEVICE

(76) Inventor: Mark E. Hartelius, 8112 Komensky, Chicago, IL (US) 60652

( * ) Notice: Subject to any disclaimer, the term of this patent is extended or adjusted under 35 U.S.C. 154(b) by 32 days.

This patent is subject to a terminal disclaimer.

(21) Appl. No.: 11/327,905

(22) Filed: Jan. 9, 2006

Related U.S. Application Data

(62) Division of application No. 10/871,257, filed on Jun. 17, 2004, now Pat. No. 7,147,536.

(60) Provisional application No. 60/482,789, filed on Jun. 26, 2003.

(51) Int. Cl.
*A63H 3/06* (2006.01)

(52) U.S. Cl. ..... 446/220

(58) Field of Classification Search ..... 446/219–221, 446/223; 362/227, 234, 362–363, 365
See application file for complete search history.

(56) References Cited

U.S. PATENT DOCUMENTS

| | | | | |
|---|---|---|---|---|
| 4,794,498 | A | 12/1988 | Neumeier | 362/186 |
| 5,117,344 | A | 5/1992 | Perez | |
| 5,499,941 | A | 3/1996 | Penjuke | |
| 5,669,702 | A | 9/1997 | Wang | 362/234 |
| 5,795,211 | A | 8/1998 | Carignan | |
| 5,947,581 | A | 9/1999 | Schrimmer et al. | |
| 6,012,826 | A | 1/2000 | Chabert | 362/363 |
| 6,032,607 | A | 3/2000 | Ashline | |
| 6,146,001 | A | 11/2000 | Cwiakala | |
| 6,238,067 | B1 | 5/2001 | Hirsch | |
| 6,482,065 | B1 | 11/2002 | Blackman | |
| 6,523,778 | B2 | 2/2003 | Key et al. | |
| 6,602,105 | B1 | 8/2003 | Sussell | |
| 2004/0116039 | A1 * | 6/2004 | Mueller et al. | 446/220 |
| 2004/0174718 | A1 | 9/2004 | Ohlund | 362/565 |
| 2004/0233674 | A1 | 11/2004 | Vanderschuit | 362/352 |

* cited by examiner

*Primary Examiner*—Robert E. Pezzuto
*Assistant Examiner*—Alex F. R. P. Rada, II
(74) *Attorney, Agent, or Firm*—Robert W. J. Usher

(57) ABSTRACT

A balloon illumination and inflation device has a tubular housing assembly comprising a balloon neck attachment at one end, an inflation mouthpiece at an opposite end; an air valve adjacent the mouthpiece, a lamp mount adjacent the one end to direct light into the attached balloon; an internal battery mount and a switch to connect the lamp to the battery circuit for illumination of the balloon interior. The switch is formed by first and second tubular housing members relative rotatable to close the air valve means and simultaneously to connect the battery circuit to the lamp.

14 Claims, 3 Drawing Sheets

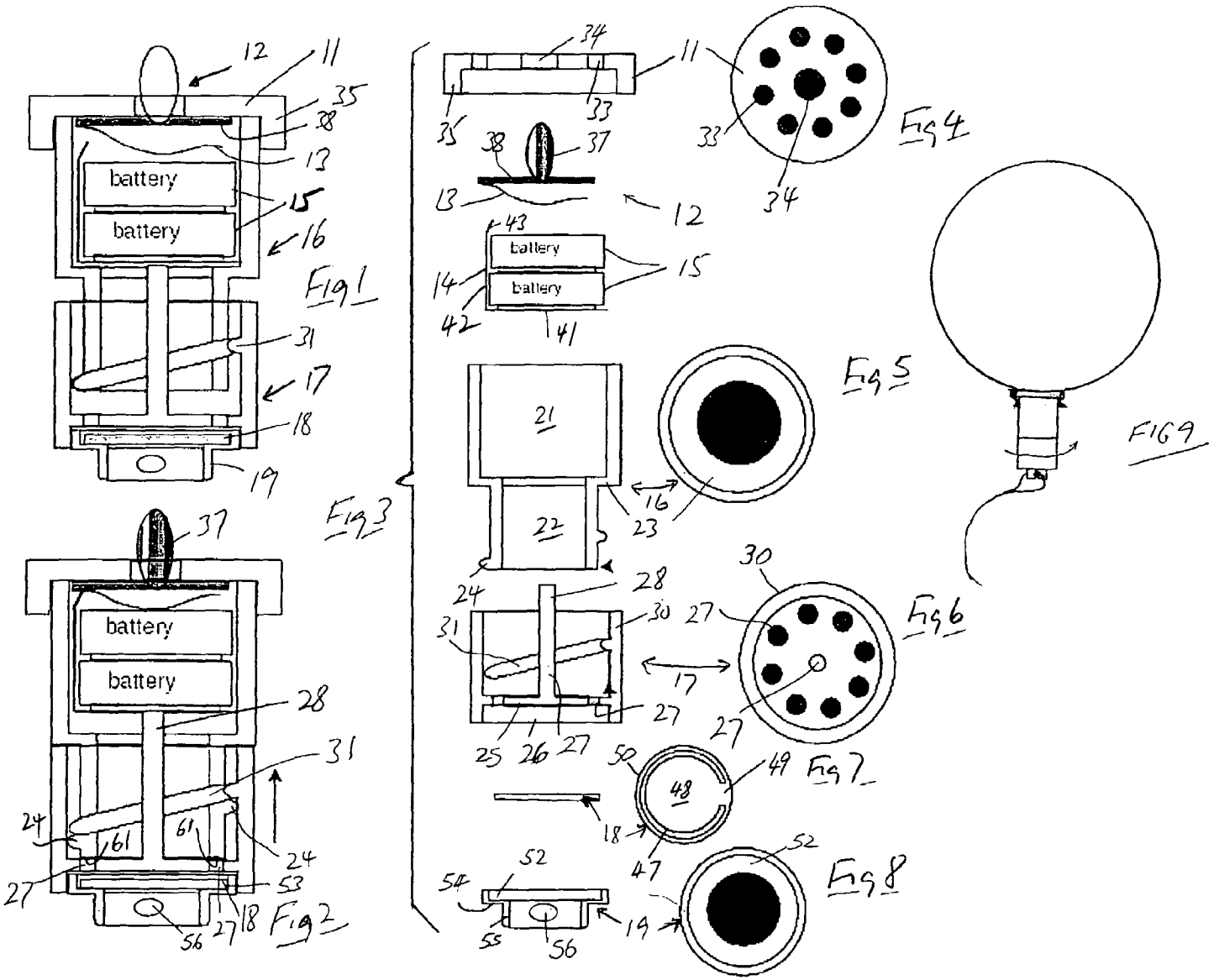
battery
battery
battery
battery

BALLOON INFLATING AND ILLUMINATING DEVICE

RELATED APPLICATION

This application is a DIV of Ser. No. 10/871,257 filed Jun. 17, 2004 now U.S. Pat. No. 7,147,536, which this application claims priority from provisional application No. 60/482,789 filed Jun. 26, 2003, the disclosure of which is incorporated herein by reference.

FIELD OF THE INVENTION

The present invention relates to a balloon illumination and inflation device

BACKGROUND OF THE INVENTION

Balloons both of latex and mylar, both inflated with air and with helium have been used as festive decoration for many years. Frequently, the decorative effect has been enhanced by illuminating said balloons internally by a lamp, often blinking, and powered by an internal or external battery or power source.

However, external power supplies have often resulted in a cumbersome and costly assembly while the lamp, internal power supplies and inflation devices have often been integral with the balloon and unsuitable for reuse with another balloon.

Prior mechanical fasteners also enable a person inflating the balloon to quickly insert the neck or nozzle into a slotted horn structure which then seals the neck or nozzle to prevent deflation. Decorative ribbons or tubes can then be attached to the structure tethering or mounting purposes.

Flashlight items that enable a child to cover the hood of a flashlight with a balloon neck and illuminate the balloon have also been available, but these require balloon inflation prior to attachment and the weight of the flashlight prevents the balloon floating freely in the air.

SUMMARY OF THE INVENTION

It is an object of the invention to provide a cost effective, relatively compact and light balloon illumination and inflation device which can be produced economically, at high volume by conventional mass production techniques and can be supplied as reusable unit for use with many different balloons.

It is an additional object of the invention to provide a balloon illumination and inflation device sufficiently light to be born aloft by the balloon.

It is a further object to provide such device which will accommodate a lamp and battery both internally and removably.

According to one aspect of the invention, a balloon illumination and inflation device comprises a tubular housing assembly comprising means at one end for attaching the balloon by the neck for inflation and illumination thereof; an inflation mouthpiece at an opposite end; valve means (adjacent the mouthpiece) for admitting inflation air to flow under pressure from the mouthpiece through the housing into the balloon; means (adjacent the attaching means) for mounting a lamp to direct light from the one end into the attached balloon; means for mounting internally a battery power source; battery circuit means; and reversible switching means operable to connect the lamp to the battery circuit for illumination of the balloon interior.

Preferably, the switching means operates the valve means to prevent escape of air from an inflated balloon through the housing during operation of the lamp.

The switching means may comprise first and second tubular housing members mounted together for limited relative movement to close the valve means and to simultaneously connect the battery circuit to the lamp.

Preferably, the second housing member is mounted in coaxial receipt of a lower end of the first housing member by cooperable screw means provided on respective housing members and the valve means comprises a transverse partition in the second housing member with at least one air hole therethrough and an actuating member projecting upwardly from the partition toward the first housing member, the battery mounting means being spaced vertically below the lamp in the first housing member and movably vertically toward and away from the lamp, whereby twisting/screwing the second lower housing member relative to the first housing member will raise the lower housing member relatively toward the first housing member (to close the valve) bringing the lower end of the first housing member into air tight covering engagement with said at least one air hole and the actuating member into engagement with the battery mounting means to raise the battery mounting means towards the bulb to complete the battery circuit to power the lamp. Untwisting/unscrewing the lower housing member lowers the actuating member, permitting the battery mounting means to fall away from the lamp extinguishing the lamp, and uncovering said at least one air hole in the partition.

Thus, operating the lamp and sealing the balloon airtight can both be effected simultaneously by a single twisting step.

Preferably, the valve means further comprises a non-return flap operatively associated with said at least one air hole or with the mouthpiece.

Desirably, the lamp is removable from the housing member.

Unlike many prior balloon illuminating devices having internal power sources, use of the balloon inflation and illuminating device is not restricted to any particular type of balloon nor is the device permanently attached to any particular balloon with which it is used to inflate or illuminate but the device is releasable and can be removed from one balloon and used to inflate or illuminate another balloon, when desired.

BRIEF DESCRIPTION OF THE DRAWINGS

In order that the invention may be readily understood, a specific embodiments thereof will now be described by way of example only and with reference to the accompanying drawings in which:

FIG. 1 is a schematic cross-sectional view of an assembled device in the OFF position, according to a first embodiment;

FIG. 2 is a similar view to FIG. 1 with the device in the ON position;

FIG. 3 is an exploded view of the device;

FIG. 4 is a plan view of the cap member of the device

FIG. 5 is a plan view of the main housing member of the device;

FIG. 6 is plan view of the lower housing member of the device;

FIG. 7 is a plan view of the flap valve member of the device;

FIG. 8 is a plan view of the mouthpiece of the device;

FIG. 9 is a schematic showing a balloon mounted on to the device with a lanyard threaded to the mouthpiece;

PARTICULAR DESCRIPTION

Figure 11:
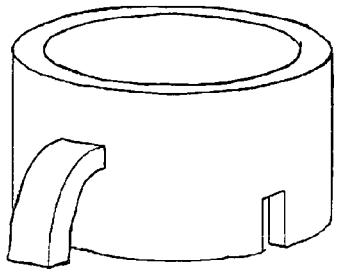
FIG. 11 is a schematic perspective of a modified mouthpiece.
Figure 12:
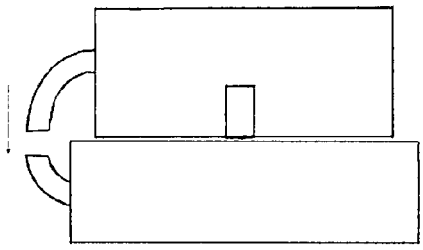
FIG. 12 is a side view of the modified mouthpiece and lower housing member showing a lanyard securing eye constituted by aligned individual hook members molded integrally with the mouthpiece and lower housing member, respectively.

As shown in the FIGS. 1-3, the balloon illuminating and inflating device comprises a cap member 11, (FIG. 4); a pcb mounted bulb/LED assembly 12 with an upper metal contact element 13; a lower metal contact member 14 for a pair of stacked button batteries 15; a main housing member 16, (FIG. 5); a lower housing member 17, (FIG. 6), a diaphragm/flap valve 18, (FIG. 7), and, a mouthpiece 19, (FIG. 8).

The cap member 11; main housing member 16; lower housing member 17 and mouthpiece 19 are each injection molded in one piece of plastic material.

The main housing member, FIGS. 1-3 and 5, is cylindrical with an upper portion 21 joined to a lower portion 22 of smaller diameter by a shoulder 23. An helical thread 24 is integrally molded around part of the external surface of the lower portion 22.

The lower housing 17, FIGS. 1-3 and 6, is cylindrical and has an internal diametric partition 25 adjacent and spaced above a lower end, forming a bottom recess 26. The partition 25 provides a valve seat formed with a ring of air holes 27 adjacent the circumference providing valve orifices and a stem 28 upstands centrally therefrom with an upper free actuating end 29 protruding above the cylindrical wall 30 of the lower hosing member. An helical thread 31 is formed extending part way around the inside surface of the wall 30.

The cap member 11, FIGS. 1-4, is disk-form with a ring of cooling apertures 33 formed around a central lamp receiving aperture 34 and has a depending, circumferential, locating flange 35.

The bulb/LED/contact assembly 12, FIGS. 1-3, comprises a bulb/LED 37 mounted on a pcb 38 with the metal cantilever spring contact 13 extending from one edge, inwardly thereunder.

The lower contact member 14, FIGS. 1-3, comprises a right angled limb with a horizontal part 41 extending under the lower of two stacked button batteries 15 and the vertical part 42 being bent in at an upper free end 43 for battery stabilization.

The diaphragm/flap valve 18, FIGS. 1-3 and 7, is formed by a one-piece elastomeric disc 46 formed around the circumference with a cut out 47 extending through approximately 345 degrees to define an inner flap valve member 48 connected by a neck 49 to an outer retaining ring 50.

The mouthpiece, FIGS. 1-3 and 8, is cylindrical with an upper recess 52 providing a valve seat 53 joined by a shoulder 54 to a lower sidewall portion 55 of reduced diameter providing a lip piece. Two apertures 56 through which a tether can be passed are formed at diametrically opposite locations of the sidewall providing the lip piece 55.

In assembling the device, the bulb/LED is inserted into the aperture 34 in the cap member 11, locating the pcb and contact spring within the flange 35 of the cap member 11, and the lower contact 14 carrying the stacked batteries 15 is loaded into the upper portion 21 of the main housing member 16. The cap in then bonded to the top of the upper portion 21. The diaphragm/valve member 18 is located on the seat 52 of the mouthpiece and the retaining annulus 50 bonded thereto. The mouthpiece 19 is then inserted into the recess 26 of the lower housing member 17 and bonded thereto mounting the flap valve extending substantially across the air holes 27 but with the cut out 47 aligned with the air holes. The lower housing subassembly thus formed is then threaded onto the lower portion of the main housing 16 by engagement of the thread 31 over the thread 24 so that the upper actuating end 28 of the stem 27, providing the assembly shown in FIG. 1.

In use, the neck of an elastomeric balloon is stretched tightly over the cap member 11 and the balloon inflated by a person blowing through the mouth piece flexing the flap member away from the mouthpiece passageway therein to admit the blown air through the passageway, cut out 47, air holes 27, central passageway of main housing 16, and passageway cap apertures 33 to inflate the balloon. The flap valve member will be urged against the valve seat 52 formed by the shoulder 54 of the lower housing member by the pressure of stored air to prevent leakage back through the mouthpiece during balloon inflation to prevent deflation. When the balloon is inflated sufficiently, the lower housing is rotated relative to the main housing causing the thread 31 thereof to ride up the thread 24 of the main housing carrying the lower housing and actuating end 28 of the stem member upward which raises the lower contact 14 and battery stack 15 so that the upper end 43 of the contact 14 and the upper face of the uppermost battery of the stack face engage a conductive track of the pcb 38 and the contact 13, respectively to complete a power lighting circuit through the bulb 37, as shown in FIG. 2. When the lower housing is completely raised, the air holes 27 are covered and sealed by the lower face 61 of the side wall of the lower portion 22 of the main housing providing an additional safeguard against balloon deflation.

A lanyard or tether can be threaded through the apertures 56 to secure the balloon. Helium may be used to inflate the balloon instead of air to provide lift causing the balloon to float in the air. The balloon may also be made of an inelastic material, as well know, but an additional sealing means sealing the balloon over the cap member must then be employed.

Figure 10:
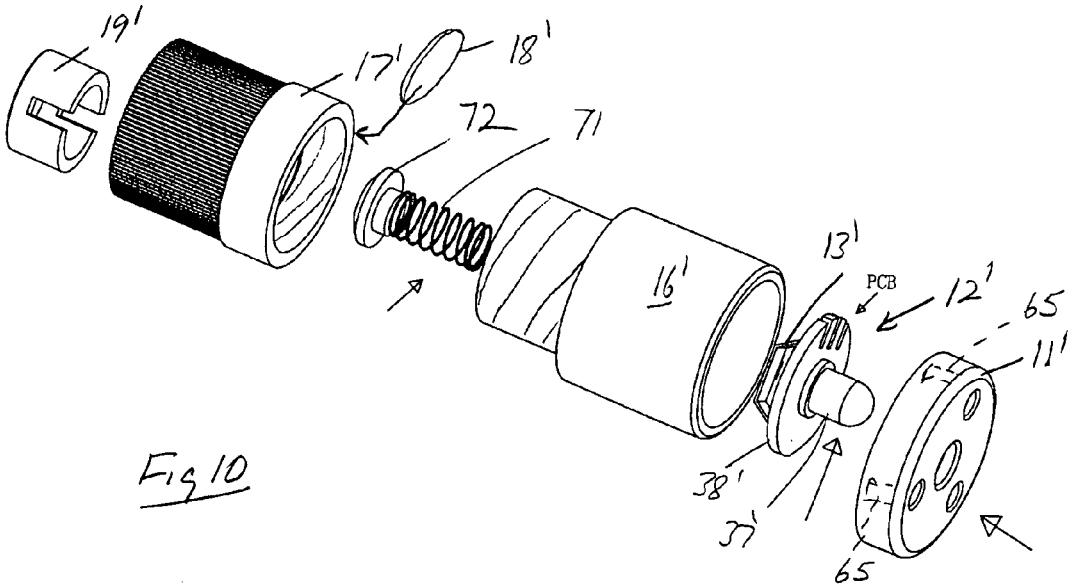
FIG. 10 is an exploded view of a second embodiment.
Figure 13:
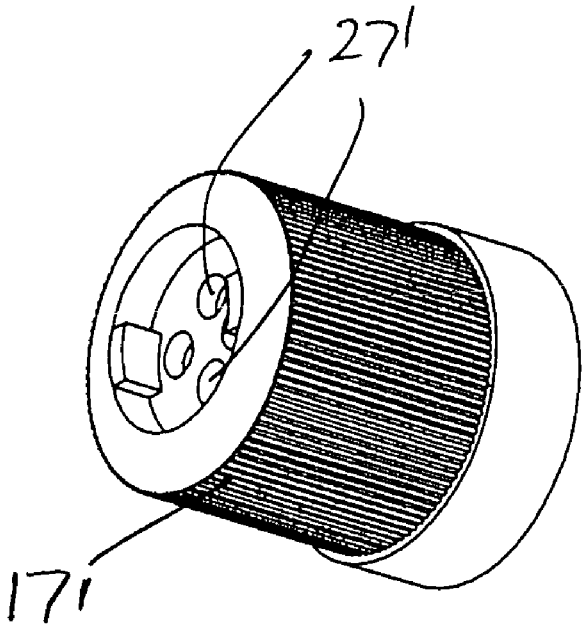
FIG. 13 is a perspective view of a lower end of the second housing member.
Figure 14:
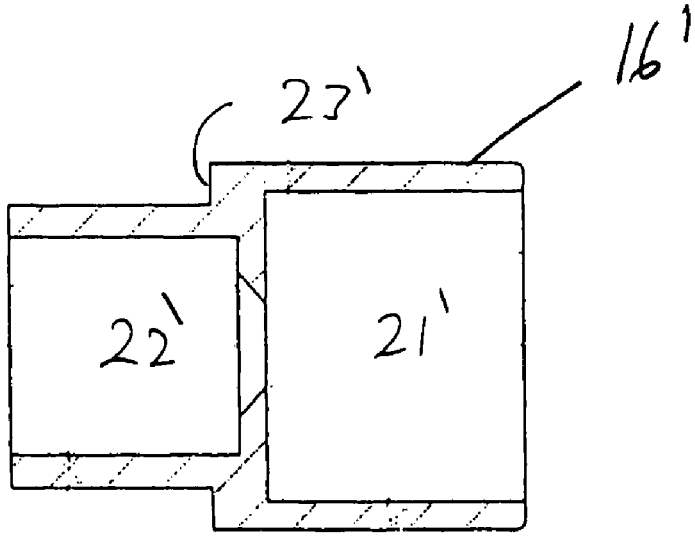
FIG. 14 is a cross-sectional view of the first housing member.

In the second embodiment shown in FIG. 10, parts which are similar, though modified, to those of the first embodiment are identified by primed reference numerals.

The cap member 11' is modified by molding with three equi-spaced hook members 65 which snap over the peripheral edge of the circuit board 37' to capture the LED assembly 12' therein.

An helical spring 71 mounted captive on a button sealing member 72 replaces the stem 28 of the first embodiment and the four air holes 27' are more centrally located so that when the lower housing member 17' is screwed up, the upper housing member 16', the upper, free end of the spring urges a battery (not shown) into electrical engagement with a beam spring contact 13' on the underside of printed circuit board 38' to illuminate the LED 37' while the button member presses down against the diaphragm 18' to seal the mouthpiece 19' airtight.

The mouthpiece and the cap with the captured LED assembly are respectively bonded attached to the lower housing member 17' and the upper housing member 16' respectively, by solvent/adhesive.

Thus, the second housing member is mounted in coaxial receipt of a lower end of the first housing member by the cooperable screw means provided on respective housing members. A valve member comprising a resilient disk diaphragm 11' is mounted on the partition extending across the air holes 27'. The resilient actuating member 71 extends upward inside the first and second housing members 16, 17, between the valve member and the battery mounting means which is spaced vertically below the lamp in the first housing member, whereby twisting/screwing the second, lower housing member relative to the first, main housing member raises the lower housing member relatively toward the first housing member, compressing the resilient actuating member axially to press the diaphragm against the air holes 27' and to raise the battery towards the bulb to complete the battery circuit to power the lamp and, untwisting/unscrewing the lower housing member lowers the actuating member, permitting the battery to fall away from the lamp extinguishing the lamp, and uncovering the air holes in the partition.

The invention claimed is:

1. A balloon illumination and inflation device comprising a tubular housing assembly having opposite axial ends and comprising means for attaching, releasably, the balloon by a neck thereof for inflation and illumination thereof; an inflation mouthpiece at an axial end; for admitting inflation air to flow under pressure through the neck into the balloon; sealing means comprising valve means for preventing escape of inflation air through the neck, means on the housing for mounting a lamp to direct light from another end into the attached balloon; means for mounting internally a battery power source; battery circuit means; and reversible switching means operable to connect the lamp to the battery circuit for illumination of the balloon interior, wherein the switching means operates the sealing means to prevent escape of air from an inflated balloon through the neck housing during operation of the lamp.

2. A balloon illumination and inflation device according to claim 1 wherein the switching means comprises first and second tubular housing members mounted together for limited relative movement to operate the sealing means and to simultaneously connect the battery circuit to the lamp.

3. A balloon illumination and inflation device according to claim 2 wherein the second housing member is mounted in coaxial receipt of a lower end of the first housing member by cooperable screw means provided on respective housing members and the sealing means comprises a transverse partition in the second housing member with at least one air hole therethrough, and an actuating member projecting upwardly from the partition toward the first housing member, the battery mounting means being spaced vertically below the lamp in the first housing member and movably vertically toward and away from the lamp, whereby twisting/screwing the second lower housing member relative to the first housing member raises the second, lower housing member relatively toward the first housing member to close the sealing means bringing the lower end of the first housing member into air tight covering engagement with said at least one air hole and the actuating member into engagement with the battery mounting means to raise the battery mounting means towards the bulb to complete the battery circuit to power the lamp and untwisting/unscrewing the lower housing member lowers the actuating member, permitting the battery mounting means to fall away from the lamp extinguishing the lamp, and uncovering said at least one air hole in the partition.

4. A balloon illumination and inflation device according to claim 3 wherein the valve means comprises a non-return flap valve member operatively associated with one of said at least one air hole and with the mouthpiece.

5. A balloon illumination and inflation device according to claim 3 wherein said at least one air hole comprises a ring of air holes and the actuating member comprises a stem which projects upwardly from a location on the partition centrally of the ring of air holes and has a free upper end which is brought in to the engagement with the battery mounting means to raise the battery mounting means.

6. A balloon illumination and inflation device according to claim 2 wherein the second housing member is mounted in coaxial receipt of a lower end of the first housing member by cooperable screw means provided on respective housing members and the sealing means comprises a transverse partition in the second housing member with at least one air hole therethrough, a valve member comprising a resilient diaphragm located on the partition and extending across said at least one air hole, a resilient actuating member extending upward inside the first and second housing members between the valve member and the battery mounting means which is spaced vertically below the lamp in the first housing member, whereby twisting/screwing the second, lower housing member relative to the first housing member raises the lower housing member relatively toward the first housing member, compressing the resilient actuating member axially to press the diaphragm against the partition to close said at least one air hole and to raise the battery towards the bulb to complete the battery circuit to power the lamp and, untwisting/unscrewing the lower housing member lowers the actuating member, permitting the battery to fall away from the lamp extinguishing the lamp, and uncovering said at least one air hole in the partition.

7. A balloon illumination and inflation device according to claim 2 wherein the housing members are mounted together in telescopic relation and the sealing means comprises a transverse partition in one housing member with at least one air hole through the partition and, the other housing member having a sealing member adjacent an axial end and an actuating member projecting upwardly into the other housing member, the battery circuit comprising at least one electrical contact movable to electrically connect and disconnect the battery from the lamp, whereby moving the housing members relative to each other in one direction brings the sealing member into air tight covering relation with said air hole to close the valve means and moves the actuating member to cause said at least one electrical contact to complete the battery circuit to power the lamp and moving the housing members relative to each other in a direction opposite to the one direction moves the actuating member to cause said at least one electrical contact to break the battery circuit to disconnect the battery from the lamp, extinguishing the lamp, and removes the sealing member from air tight covering relation with said air hole to open the valve means.

8. A balloon illumination and inflation device according to claim 1 wherein, the lamp mounting means mounts the lamp removably in the housing member.

9. A balloon illumination and inflation device comprising a tubular housing assembly having opposite axial ends and receivable in a neck of a balloon or inflation and illumination thereof; and comprising an inflation mouthpiece at one axial end; sealing means for preventing escape of inflation air through the neck of the balloon and comprising valve means, for admitting inflation air to flow under pressure from the mouthpiece through the neck into the balloon; means for mounting a lamp to direct light from another end into the balloon; means for mounting internally a battery power source; battery circuit means; and reversible switching means operable to connect the lamp to the battery circuit for illumination of the balloon interior, wherein the switching means assists in sealing the balloon to prevent escape of inflation air therefrom through the neck when operating to connect the lamp to the battery circuit for illumination of the balloon interior.

10. A balloon illumination and inflation device according to claim 9 wherein the switching means comprises a switching member mounted on the housing assembly for axial switching movement relative thereto which switching movement both connects the lamp to the battery circuit and moves the sealing means to a different sealing position.

11. A balloon illumination and inflation device according to claim 10 wherein the sealing means comprises an annular sealing member coaxial with the housing.

12. A balloon illumination and inflation device comprising a tubular housing assembly having opposite axial ends and receivable in a neck of a balloon for inflation and illumination thereof comprising an inflation mouthpiece at one end for admitting inflation air to flow under pressure through the neck into the balloon; sealing means comprising valve means for preventing inflation air escaping from the balloon through the neck; means for mounting a lamp to direct light from an end into the attached balloon; means for mounting internally a battery power source; battery circuit means; and, reversible switching means operable to connect the lamp to the battery circuit for illumination of the balloon interior, wherein the switching means and the sealing means comprise a common member mounted on the housing assembly for movement by operation of the switching means both to connect the lamp to the battery circuit and to change a sealing position of the sealing means to assist in sealing the balloon to prevent escape of air through the neck thereof.

13. A balloon illumination and inflation device according to claim 12 wherein the common member is mounted for movement axially along the housing assembly.

14. A balloon illumination and inflation device according to claim 13 wherein the common member comprises an annular sealing portion.

* * * * *